United States Patent [19]

Jennings et al.

[11] 4,266,717

[45] May 12, 1981

[54] PLATEN, HOLDER AND LATCH ASSEMBLY FOR SECURING PLATENS IN PLACE WITHIN A CENTRIFUGE DEVICE

[75] Inventors: C. Michael Jennings, Reston, Va.; Albert Kitchenham, Laurel; Rene Lamadrid, Bethesda, both of Md.

[73] Assignee: Baxter Travenol Laboratories, Inc., Deerfield, Ill.

[21] Appl. No.: 102,747

[22] Filed: Dec. 12, 1979

Related U.S. Application Data

[63] Continuation-in-part of Ser. No. 29,742, Apr. 13, 1979, Pat. No. 4,195,766.

[51] Int. Cl.[3] ..... B04B 7/12

[52] U.S. Cl. ..... 233/26

[58] Field of Search ..... 233/26, 27, 1 R, 1 D, 233/1 E, 1 A; 366/213, 214, 215, 217, 208, 209, 210, 211

[56] References Cited

U.S. PATENT DOCUMENTS

| | | | |
|---|---|---|---|
| 3,064,647 | 11/1962 | Earl | 233/26 |
| 3,163,404 | 12/1964 | Kraft | 233/26 |
| 3,497,183 | 2/1970 | Corey | 366/214 |
| 3,891,140 | 6/1975 | Ayres | 233/26 |

*Primary Examiner*—Robert W. Jenkins

*Attorney, Agent, or Firm*—Robert A. Benziger; Thomas R. Vigil; Paul C. Flattery

[57] ABSTRACT

The assembly is utilized in a centrifuge device wherein a receptacle is received and held between first and second platens which are held within a platen holder fixed to the centrifuge device and in respective inner and outer parallel planes spaced radially outwardly from a vertical axis of rotation of the centrifuge device. The first platen is movable with one side wall of the holder about a generally horizontal axis extending along a lower edge of a second side wall of the holder. A latch mechanism provides for a toggle latching action between the walls as the latch mechanism is moved from an open position to a closed position. In one embodiment of the latch mechanism a handle is connected to a shaft journalled on the one side wall and mounts a plate on each end thereof with each plate having a pin extending therefrom that is rotated within a keeper member on an edge of the second wall to latch the platens in place. In another embodiment of the latch mechanism, two linkages are provided between the walls at the top of the holder. A linking pivot connection of each linkage is movable upwardly and then downwardly to allow the one side wall to be moved toward and away from the second side wall. Also in this embodiment the platens are inserted into the holder from the top thereof and this facilitates easy insertion and/or replacement or interchange of platens in the assembly. In the latched position, the one side wall is pressed against the platens.

19 Claims, 17 Drawing Figures

FIG. 1
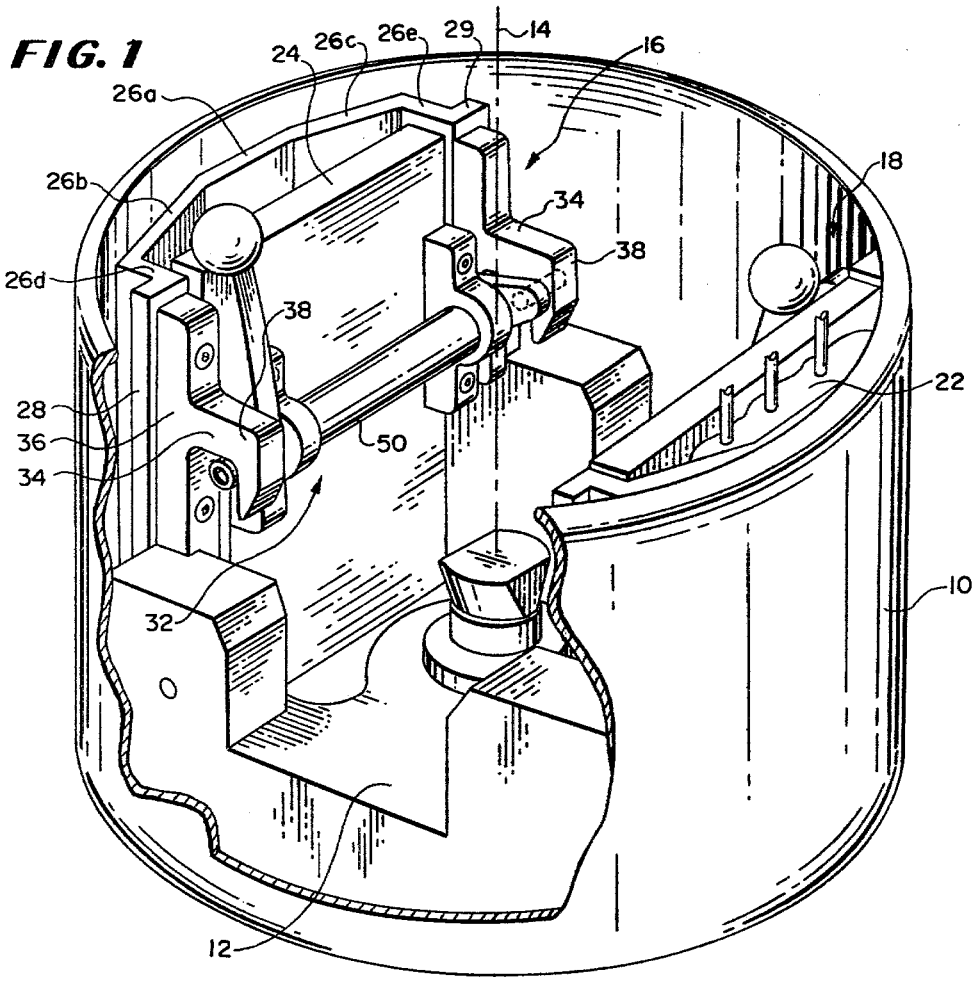
FIG. 2
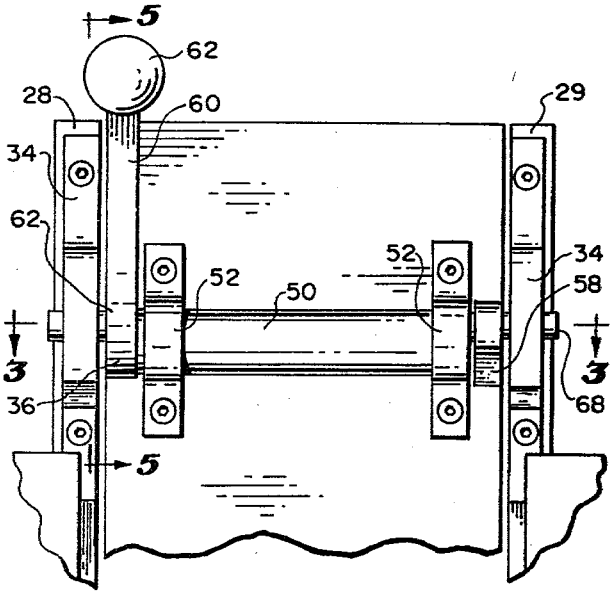
FIG. 3
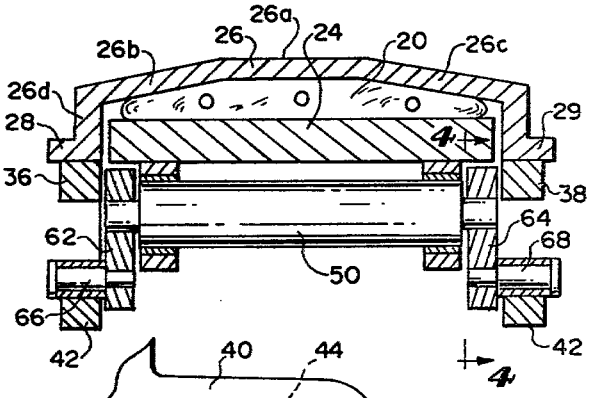
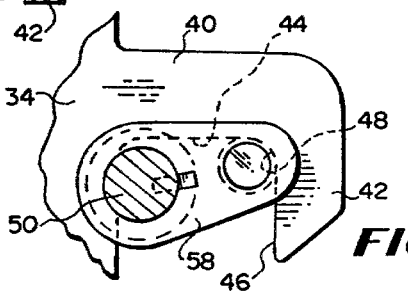
FIG. 4

PLATEN, HOLDER AND LATCH ASSEMBLY FOR SECURING PLATENS IN PLACE WITHIN A CENTRIFUGE DEVICE

CROSS REFERENCE TO RELATED APPLICATION

This application is a continuation-in-part of application Ser. No. 029,742 filed Apr. 13, 1979 and entitled LATCH ASSEMBLY FOR LATCHING PLATENS IN PLACE WITHIN A CENTRIFUGE DEVICE, now U.S. Pat. No. 4,195,766.

BACKGROUND OF THE INVENTION

1. Field of the Invention

The field of the invention is a platen, holder and latch assembly for receiving and latching a receptacle between first and second platens in a centrifuge device such as found in a centrifugal liquid processing apparatus and to a modular platen and holder assembly for facilitating interchange of platens.

2. Description of the Prior Art

Heretofore various means such as bolts and clamps have been utilized for holding a receptacle between two platens in a centrifugal liquid processing apparatus. Further details of the construction and operation of such a centrifugal liquid processing apparatus are disclosed in application Ser. No. 843,296 filed Oct. 18, 1977, now U.S. Pat. No. 4,146,172, entitled: CENTRIFUGAL LIQUID PROCESSING APPARATUS and application Ser. No. 843,222 filed Oct. 18, 1977, now U.S. Pat. No. 4,185,629, entitled: METHOD AND APPARATUS FOR PROCESSING BLOOD, the disclosures of which are incorporated herein by reference.

The previously utilized means, such as clamps and bolts, for clamping two platens together with a receptacle therebetween and with elastomeric linings between the inner side of one or both platens and the receptacle have not always provided a good clamping of the platens inasmuch as the vibrations incurred during operation of the centrifuge device cause the clamps and bolts to loosen. Also, once a quantity of liquid had been processed in the apparatus, the clamps and bolts took some time to release in order to remove the receptacle from the platens.

Also, heretofore, various means have been proposed for securing articles in a centrifuge device and disclosures of such securing means can be found in the following patent publications:

| U.S. Pat. No. | PATENTEE |
|---|---|
| 914,290 | Kropp |
| 2,655,821 | Cook |
| 3,674,197 | Mitchell et al. |
| 4,052,164 | Konig |
| 4,052,165 | Wienchol et al. |
| GERMAN PUBLICATIONS | |
| Auslegeschrift 1,598,537 | |
| Offenlegungsschrift 2,316,015 | |

As will be explained in greater detail hereinafter, the latch mechanism of the present invention differs from the previously proposed clamping means for clamping two platens together in a centrifuge device by providing a latch mechanism with a toggle latching action which includes a simple mechanism for latching and unlatching the two platens together with the receptacle held therebetween and which is constructed, arranged and oriented so that centrifugal forces on the assembly will cause the platens to stay latched even when vibrations are incurred by the centrifuge device.

Also, the present invention provides a platen, holder and latch assembly which includes easily removable and replaceable platens so that the same assembly can be used for receptacles of different shape merely by changing the two platens.

SUMMARY OF THE INVENTION

According to the invention there is provided in a centrifuge device of the type wherein a receptacle is received and held between first and second platens which are held in generally upright, respective, inner and outer parallel planes spaced radially outwardly from a verrtical axis of rotation of the device with the first platen being situated in the inner plane and the second platen being fixed in the outer plane, the improvement comprising a platen, holder and latch assembly including a holder having a fixed outer wall and a movable inner wall pivotally mounted to the bottom of said fixed outer wall, a first platen positioned in said holder against said inner wall and movable therewith, a second platen positioned within said holder against said outer wall and a latch mechanism associated with said inner and outer walls of said holder and having means providing a toggle locking between said inner and outer walls.

Further according to a preferred embodiment of the invention there is provided a platen, holder and latch assembly wherein the platens are separable from the holder and easily slid into or out of the holder. Also in the preferred embodiment, the latch mechanism includes two linkages on either side of the holder pivotally connected between the inner wall and the outer wall with a linking pivot connection between two links of each linkage being movable upwardly and downwardly to enable movement of the inner wall toward or away from the outer wall for opening the holder to insert or remove platens or for closing the holder to clamp platens between the walls of the holder.

BRIEF DESCRIPTION OF THE DRAWINGS

FIG. 1 is a perspective view with portions broken away of a drum utilized in a centrifuge device, and shows a rotor having one embodiment of a platen, holder and latch assembly of the present invention mounted thereon for holding platens which are locked in place by a latch mechanism of the assembly which is constructed in accordance with the teachings of the present invention.

FIG. 2 is a fragmentary vertical view of one inner wall of the assembly.

FIG. 3 is a sectional view taken along line 3—3 of FIG. 2.

FIG. 4 is a sectional view taken along line 4—4 of FIG. 3.

DESCRIPTION OF THE PREFERRED EMBODIMENT(S)

Figure 5:
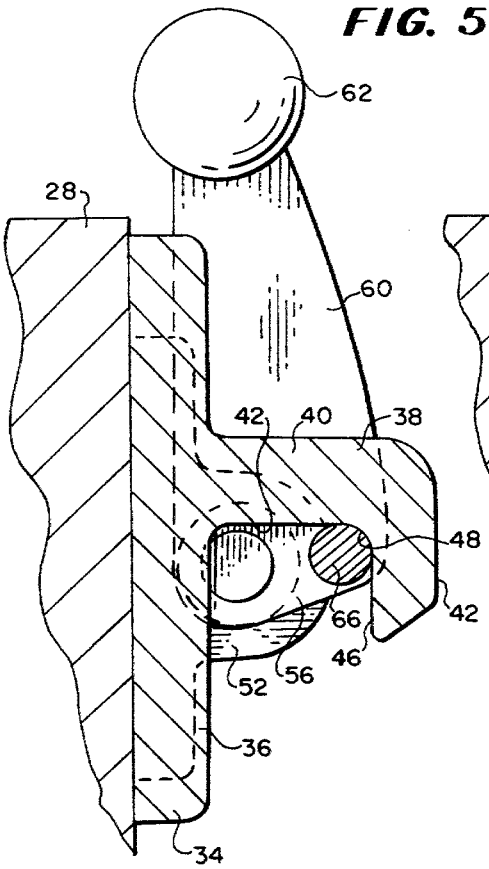
FIG. 5 is a vertical sectional view taken along line 5—5 of FIG. 2.

Referring to the drawings in greater detail, there is illustrated in FIG. 1 a drum 10 and a rotor 12 of a centrifuge device utilized in a centrifugal liquid processing apparatus which can be of the type disclosed in application Ser. No. 843,296 filed Oct. 18, 1977 entitled: CENTRIFUGAL LIQUID PROCESSING APPARATUS and application Ser. No. 843,222 filed Oct. 18, 1977 entitled: METHOD AND APPARATUS FOR PROCESSING BLOOD, the disclosures of which are incorporated herein by reference.

The rotor 12 is arranged for rotation about a vertical axis 14 and has mounted thereon in generally upright positions two platen, holder and latch assemblies 16 and 18, each of which is spaced outwardly from the axis 14. Each assembly 16 and 18 is adapted to hold a receptacle 20 (FIG. 3) or 22 which is typically in the form of a plastic bag. In the use of the centrifuge device, liquids to be centrifuged are placed in the receptacles 20 and 22 held within the platen, holder and latch assemblies mounted on the rotor 12 and the rotor 12 is rotated. Since the assemblies 16 and 18 are substantially identical, only the assembly 16 will be hereinafter described in detail.

As shown in FIGS. 1 and 3, the platen, holder and latch assembly 16 includes a first or inner wall/platen 24 which is located in a first upright plane and a second or outer wall/platen 26 which is located generally in a second upright plane spaced outwardly from the axis of rotation of the rotor. Although not shown, it is to be understood that one or both of the platens 24 and 26 can have an elastomeric lining facing toward the other platen 26 or 24 to permit compression of the receptacle 20 located between them.

As shown in FIGS. 1 and 3, the first platen 24 is generally planar and is mounted for pivotal movement about a horizontal axis extending along the lower edge of the inner platen 24. The pivot mounting is hidden from view in the Figures. The second wall/platen 26 has a generally U shaped cross section with an outer wall portion 26*a*, two inclined wall portions 26*b*, 26*c* and two narrow width sidewall portions 26*d*, 26*e* so that the first platen 24 can fit within the second platen 26 between the sidewall portions 26*d* and 26*e* for holding a receptacle 20 therebetween. The second wall/platen 26 is also provided with side flanges 28 and 29.

According to the teachings of the present invention, each assembly 16 (18) includes a latch mechanism 32. As shown, the latch mechanism 32 includes first and second keeper members 34 each of which is mounted to one of the side flanges 28 and 29. Each of the keeper members 34 includes a base portion 36 fixed to one of the flanges 28, 29 and a hook or catch portion 38 extending outwardly from the base portion 36. The hook portion 38 has a generally L shaped configuration with a first leg 40 thereof extending outwardly from the base portion 36 and a second leg 42 extending generally vertically downwardly from the first leg 40. The first leg 40 has an undersurface 44 and the leg 42 has an inner surface 46. The surfaces 44 and 46 meet at a rounded corner 48.

The latch mechanism 32 further includes a shaft 50 which is journalled by two journal members 52 to an outer surface 54 of the first platen 24. On each side of the shaft 50 is located a latch mounting member 56, 58. The latch mounting member 56 has an elongate portion 60 extending therefrom with a ball 62 at the end thereof forming a handle. The other latch mounting member 58 is smaller as shown in FIGS. 1 and 4. Extending outwardly from the outer side 62, 64 of each latch mounting member 56 and 58 is a stub pin 66 and 68 each of which is designed to engage the inner facing surface 46 of the second leg 42. Each pin 66, 68 forms a latch member which is adapted to be received in the rounded inner corner 48 of each keeper member 34.

Figure 6:
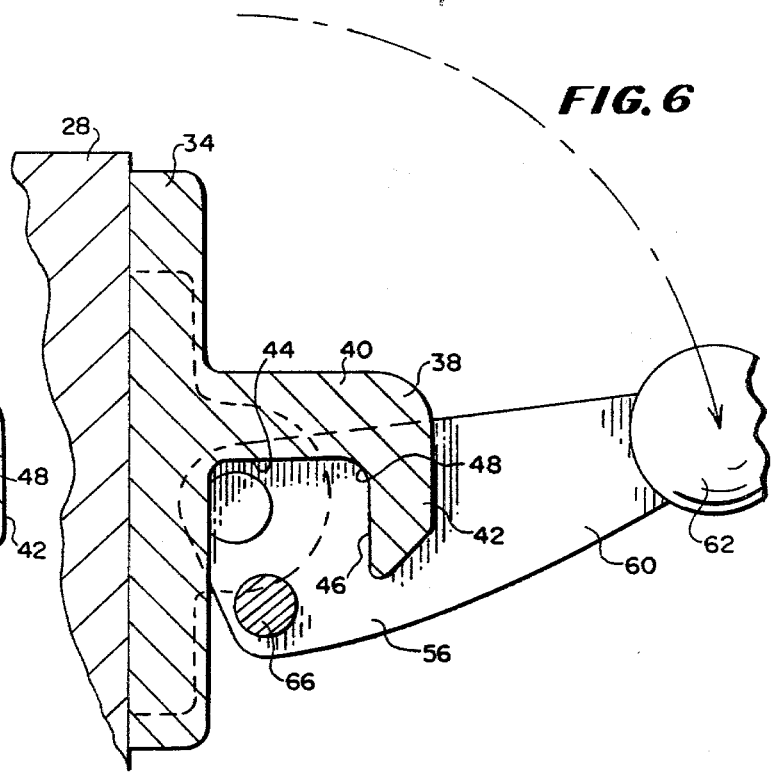
FIG. 6 is a sectional view similar to FIG. 5 and shows a handle of the latch mechanism released from a keeper for unlatching two platens positioned in the assembly.
Figure 7:
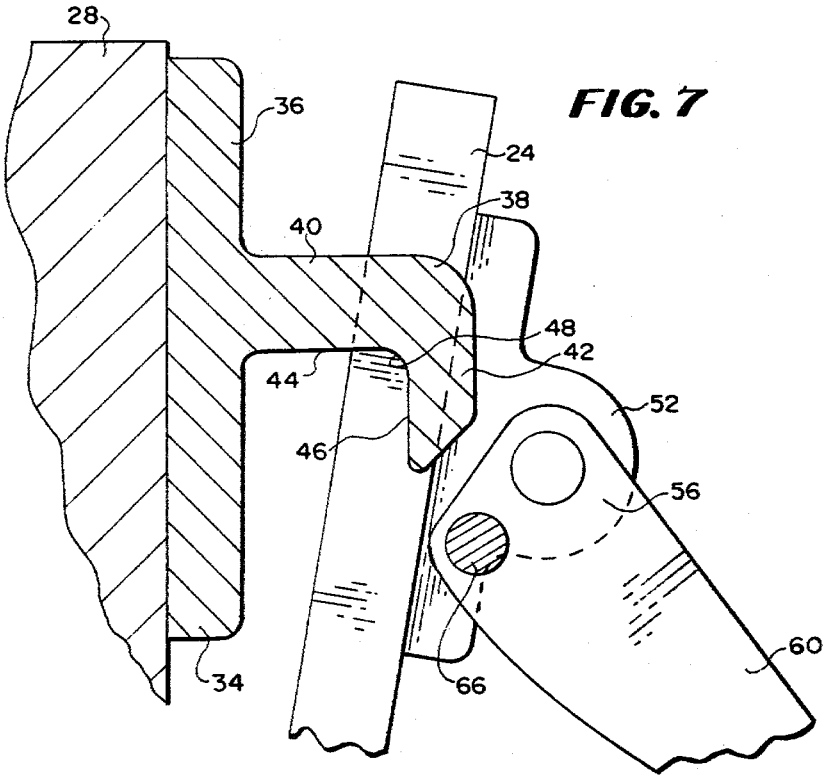
FIG. 7 is a sectional view similar to FIG. 6 and shows the handle in a lowered position and an inner wall of the platen holder pulled away from an outer wall of the platen holder.

As best shown in FIGS. 5, 6 and 7, the axis of the shaft 50 is located beneath the plane of the downwardly facing surface 44 of the first leg 40 of each keeper member 34 and the axis of the pins is coaxial and spaced from the axis of the shaft 50. It will be apparent from FIGS. 4, 5 and 6 that when the first platen 24 is pulled upwardly, such as by gripping the top of the first platen 24 by hand, and brought to an upright position, as shown in FIGS. 1, 2 and 3, the handle 60 is then rotated from its lower position shown in FIG. 7 upwardly to the position shown in FIG. 6 to the position shown in FIG. 5. During the movement, the pins 66, 68 will rotate through an arc which would normally intersect the vertical, inwardly facing surface 46 of the keeper members 34. However, in view of the resiliency of the elastomeric lining of one or both of the platens 24 and 26, the shaft 50 and the first or inner platen 24 will move inwardly compressing the elastomeric lining while the pins 66 and 68 ride on the inner surface 46 until each pin 66, 68 reaches the respective corner 48. As this occurs, the axis of the shaft will move slightly outwardly relative to the axis 14 as the elastomeric lining is compressed and then slightly inwardly relative to the axis 14 to the position shown in FIGS. 4 and 5 where each pin 66, 68 is located in a toggle locking position in the respective corner 48.

With the latch mechanism 32 of the present invention constructed, dimensioned and arranged in the manner described above and illustrated in the drawings, it will be apparent that when it is desired to open either assembly 16 or 18, the handle 60 is moved downwardly compressing the elastomeric lining slightly to unsnap or untoggle the pins 66, 68 from the keeper members 34. Then, with the handle 60 hanging downwardly, the inner platen 24 can be grasped at the top thereof and moved inwardly and downwardly relative to the axis 14 away from the outer platen 26 to insert or remove a bag/receptacle 20, 22 from the assembly 16 or 18.

When it is desired to clamp the platens 24 and 26 together with a receptacle 20 or 22 therebetween, a receptacle 20 or 22, namely a plastic bag, is inserted between the platens 24, 26 and the inner platen 24 is gripped by hand at the upper edge thereof and pulled upwardly into its upright position. Then, the handle 60 is moved from its position shown in FIG. 7 upwardly to the position shown in FIGS. 6 and 5 to bring the pins 66 and 68 into the keeper members 34 with a toggle action occurring as the pins 66, 68 move into the corner 48.

Figures 8, 9, 10:
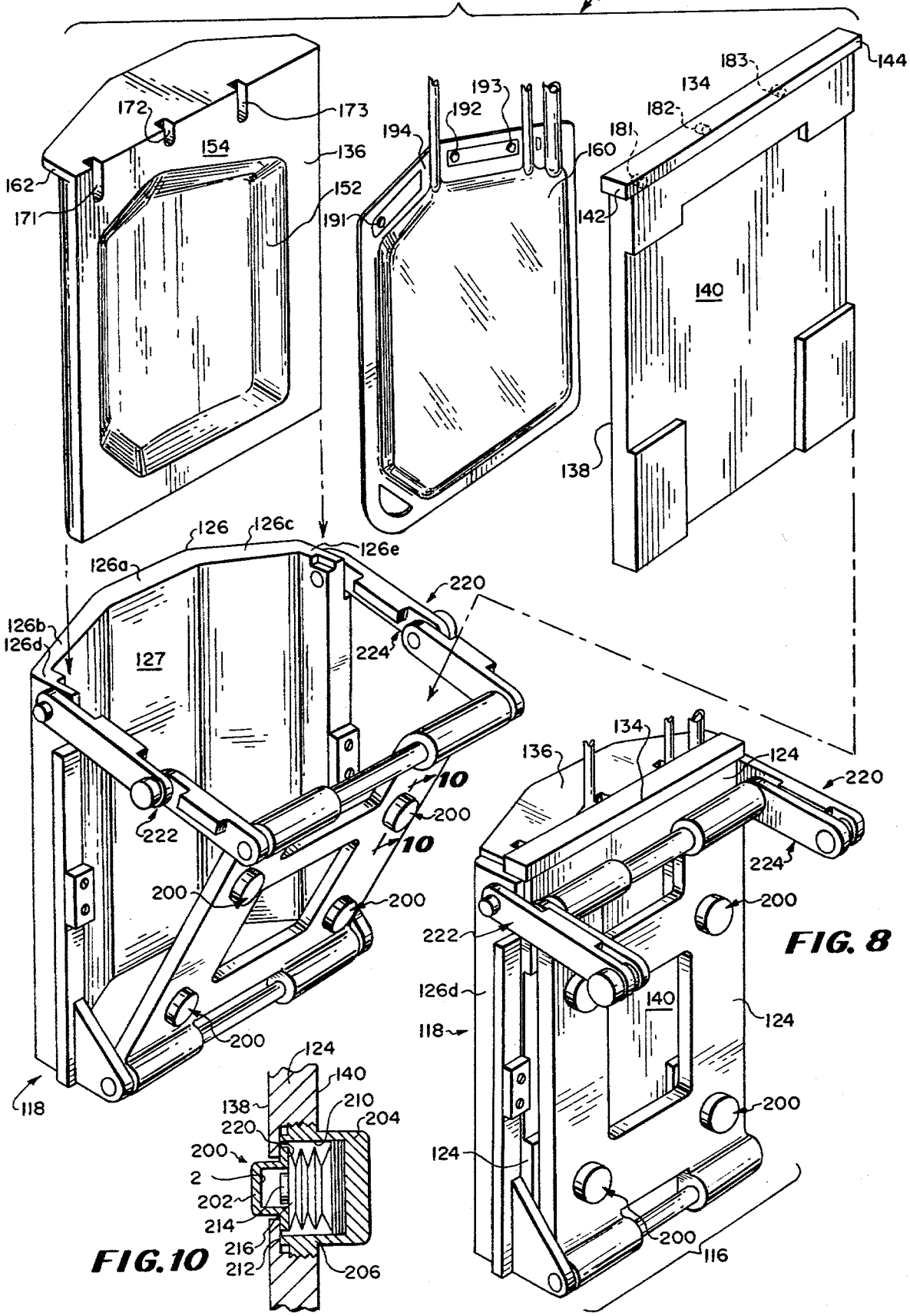
FIG. 8 is a perspective view of another embodiment of a platen, holder and latch assembly constructed according to the teachings of the present invention and having two platens secured therein by another embodiment of a latch mechanism constructed according to the teachings of the present invention.
FIG. 9 is an exploded perspective view of the platen, holder and latch assembly shown in FIG. 8 with the holder shown in its open position and the latch mechanism shown in its unlatched position.
FIG. 10 is a sectional view through a pressure applying member for applying pressure to the platens and is taken along line 10—10 of FIG. 8.

Referring now to FIGS. 8 and 9 there is illustrated therein another embodiment of a platen, holder and latch assembly of the present invention which is generally identified by reference numeral 116. As shown, this assembly 116 includes a holder 118 comprising a generally planar inner wall 124 and a convex configured outer wall 126 with a concave inner surface 127. The outer wall 126 has a back wall portion 126*a*, two inclined wall portions 126*b* and 126*c*, and two narrow wall portions or side flanges 126*d*, 126*e*.

The assembly 116 also includes a slide in (drop in) first or inner platen 134 which is made of metal. This first or inner platen 134 is separable from the holder 118 and is not integral with the inner wall 124 as in the assembly 16 shown in FIGS. 1–3.

The assembly 116 further includes a slide in (drop in) second or outer platen 136 which is made of an elastomeric material, e.g., polypropylene. The inner platen 134 can have a planar surface (not shown in FIGS. 8 and 9) on an inner side 138 thereof or can have a configured surface as will be described below in connection with the description of FIG. 17. Also, as shown in FIG. 9, a portion of an outer side 140 thereof is relieved to reduce the weight of the platen 134. In other embodiments of the platen 134, reduction of weight is not necessary and no relief is provided. The inner platen 134 also has two lip formations 142, 144 extending at the top thereof from either side thereof. The lip formations 142, 144 engage and rest on the top of the holder 118 and limit the extent of insertion of the inner platen 134 into the holder 118.

The second, outer platen 136 shown in FIG. 9 has a cavity 152 in an inner side 154 thereof particularly configured for receiving a bag/receptacle 160 having a similar configuration. The second platen 136 can, of course, have a planar surface as will be described in connection with the description of FIG. 16. This second, outer platen 136 is also removable and replaceable in the same manner as the first, inner platen 134 and, as shown in FIG. 9, has a lip formation 162 extending at the top thereof from the side and back thereof for engaging the top of the holder 118 to limit the extent of insertion of the outer platen 136 into the holder 118. Although hidden from view in FIG. 9, it will be understood that the back of the second platen 136 has a convex configuration adapted to mate and seat against the concave inner surface 127 of the outer wall 126.

Also, as shown in FIGS. 8 and 9, one of the platens 134, 136, such as the outer platen 136, will have several (in this instance three) notches 171–173 on the inner side 154 thereof and the opposing inner side 138 of the inner platen 134 will have three mating pins 181–183 extending therefrom. The pins 181–183 are adapted to mate with holes 191–193 in a sealed edge 194 of the bag/receptacle 160 and then mate with the notches 171–173 in the other platen 136 for aligning the platens 134, 136 together as well as the bag/receptacle 160 held therebetween.

The platens 134 and 136 are easily inserted into and removed from the holder 118 (i.e., they are slid in or dropped in) to facilitate easy replacement and interchange of platens. Also, to facilitate locating of each of the platens, each has lip formations extending therefrom such as lip formations 142, 144 extending from each side edge of the inner, first platen 134 and the lip formation 162 extending from the top side and back edge of the second, outer platen 136.

Figure 11:
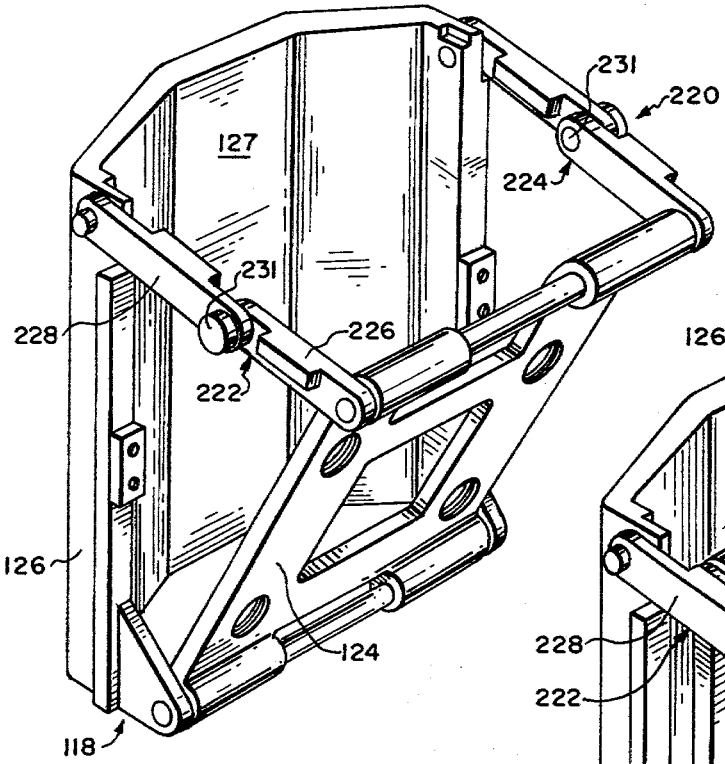
FIG. 11 is a perspective view of the holder and latch mechanism shown in their open positions.
Figure 12:
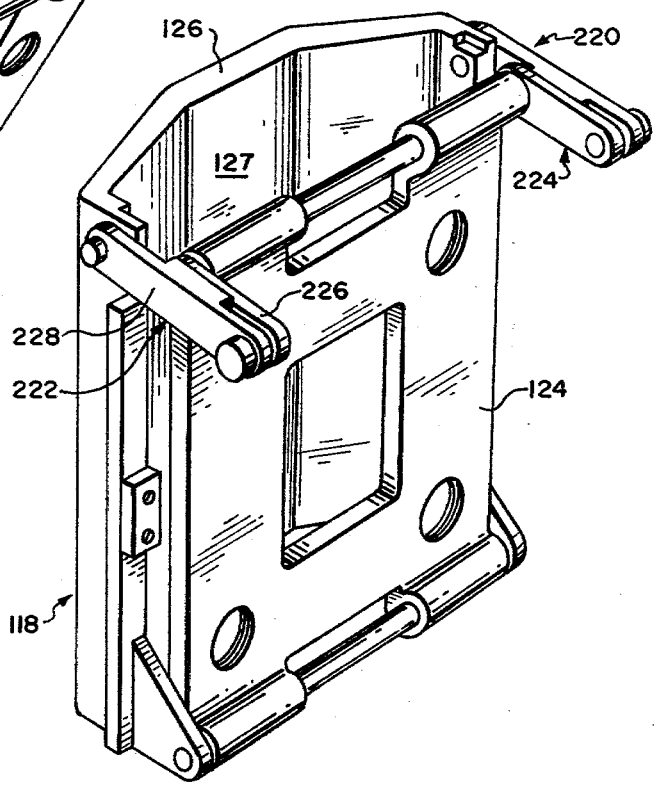
FIG. 12 is a perspective view of the holder and latch mechanism shown in their closed positions.

Referring to FIGS. 9, 10 and 11, the inner wall 124 is provided with four pressure applying members 200 which are arranged to form a rectangular configuration thereby to apply pressure at four points on the outer side of the inner platen 134 when the inner wall 124 is raised upwardly and toward the outer wall 126 to clamp the first and second platens 134, 136 together with a bag/receptacle 160 therebetween. Each pressure applying member 200 includes a spring biased cap member 202 extending outwardly from the inner side 138 of the inner wall 124. Each of these cap members 202 is adapted to engage and bear against the first platen 134 and press the same against the outer platen 136 when the walls 124, 126 and platens 134, 136 are clamped together. In the particular embodiment illustrated in FIG. 10, the pressure applying member includes a plug member 204 having a threaded stem portion 206. The inner wall 124 is provided with four spaced apart holes 208 therein each of which is threaded for receiving a stem portion 206. Each plug member 204 has a generally cylindrical cavity 210 therein which opens onto a free or bottom end 212 of the stem portion 206. Inside this cavity 210 is a central pin 214 on which are positioned a plurality of Belleville washers 216 which are made of spring metal and which are dish shaped to allow flexing of same when pressure is applied against them. As shown, each of the cap members 202 has a cavity 218 therein which is received over the end of a pin 214 such that an edge 220 of the cap member 202 bears against the plurality of washers 216.

Referring now to FIGS. 11–15, the platen, holder and latch assembly 116 includes a latch mechanism 220. The latch mechanism 220 is defined by two mirror image linkages 222 and 224, each of which is pivotally connected between a side edge (such as side edge 225) of the inner wall 124 and a side flange 126*d* or 126*e* of the outer wall 126 adjacent the top of the holder 118. Since the linkages 222 and 224 are substantially identical, only the linkage 222 will now be described in detail.

As shown in FIGS. 11–15, the linkage 222 includes a first, short link 226 and a second, longer link 228. The first link 226 is pivotally connected at a first end 230 thereof by a linking pivot connection or pivot pin 231 to a first end 232 of the second link 228. A second end 234 of the first link 226 is pivotally connected to the side edge 225 of the inner wall 124 adjacent the top thereof. A second end 236 of the second link 228 is pivotally connected to the side flange 126*d* adjacent the top of the outer wall 126. The linking pivot connection 231 of the linkage 222 is generally coaxial with the linking pivot connection 231 of the linkage 224.

Figure 13:
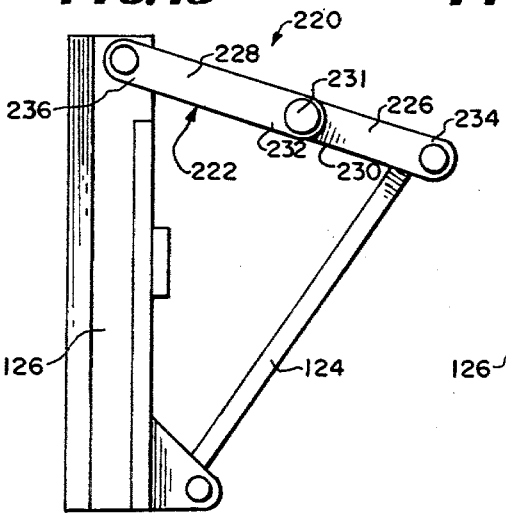
FIG. 13 is a vertical side view of the open holder and latch mechanism shown in FIG. 11.
Figure 14:
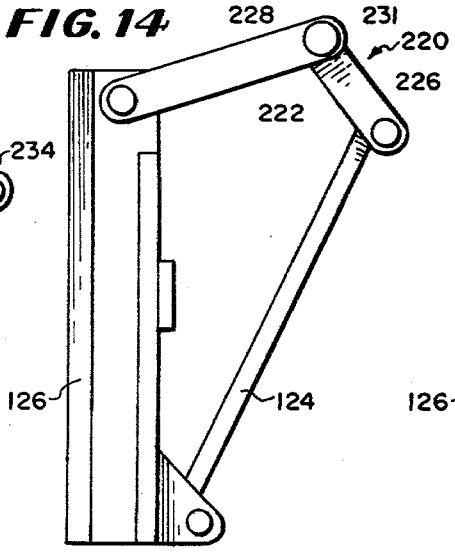
FIG. 14 is a vertical side view of the holder and latch mechanism in a partially open position.
Figure 15:
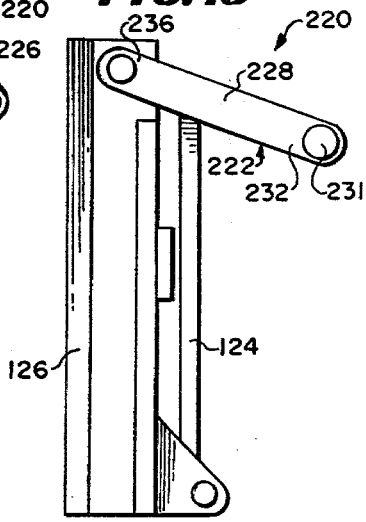
FIG. 15 is a vertical side view of the closed holder and latch mechanism shown in FIG. 12.

The linkages 222, 224 are constructed and arranged so that when each linkage 222, 224 is in an extended position as shown in FIGS. 11 and 13, the links 226, 228 extend away from each other essentially end to end with the axis of the linking pivot connections 231 lying between and parallel to the inner wall 124 and outer wall 126. In this open position of the holder 226 with the walls 124, 126 spread apart, that is to say, with the inner wall 124 pivoted away from the outer wall 126, an open space is provided for inserting the inner platen 134, the outer platen 136, and a bag/receptacle 160 configured to fit, and to be received, between the platens 134, 136 as shown in FIG. 9. Then, when one or both of the linking pivot connections 231 is lifted upwardly, the inner wall 132 (and inner platen 134 adjacent thereto) is raised upwardly and outwardly toward the outer wall 136. Next, the first link 226 is pushed toward and beneath the second link 228 and toward the adjacent side flange 126*d* or 126*e* to move the inner wall 124 toward the outer wall 126. As this occurs, the axis of the linking pivot connections 231 moves arcuately upwardly and outwardly and then arcuately downwardly and outwardly such that the second link 226 is rotated about the linking pivot connection 231 through an arc of about 180°. As this occurs, the inner wall 124 is brought inwardly toward the outer wall 126 to and through a furthest closed position and then slightly away from the outer wall 126 inwardly toward the vertical axis of the centrifuge device to provide a toggle locking action. With this operation of the latch mechanism 220, the platens 134 and 136 are held firmly in place and any centrifugal force on the inner wall 124 will urge it outwardly so as to keep the walls 124, 126 and platens 134, 136 clamped together. Also, in order to unlatch the walls 124, 126, the platens 134, 136 and bag/receptacle 160 held therebetween, the first link 226 is rotated about the pivot connection of the first end 230 of the first link 226 to the first end 232 of the second link 228 causing the second end 234 of the first link 226 to travel through an arc of about 180° such that the inner wall 124 is moved toward and then slightly away from the outer wall 126.

Figure 16:
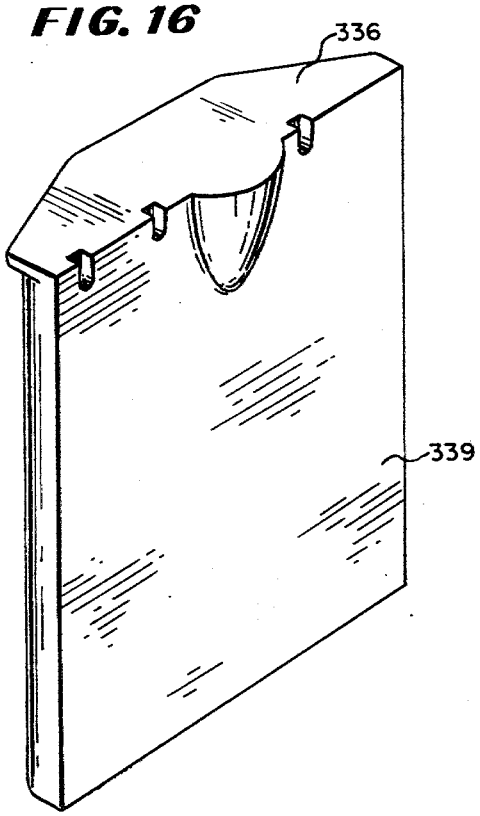
FIG. 16 is a perspective view of another form of an elastomeric platen which can be inserted in the holder.
Figure 17:
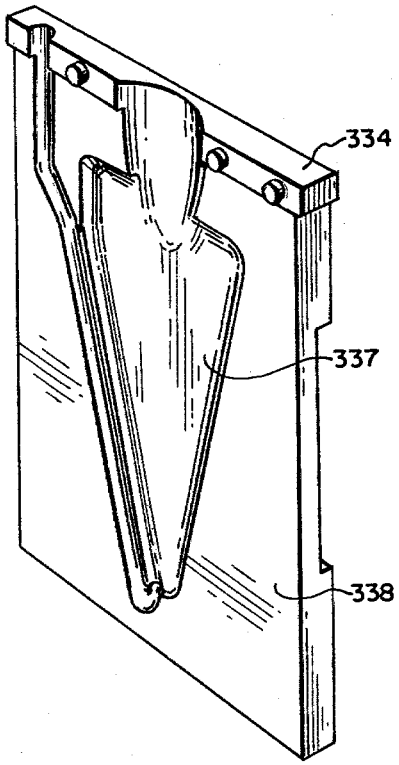
FIG. 17 is a perspective view of another form of a metal platen which can be inserted in the holder and which is configured to mate with the platen shown in FIG. 16.

As noted above, the platens 134 and 136 are interchangeable with similar platens such as with another first or inner platen 334 shown in FIG. 17 and another second or outer platen 336 shown in FIG. 16. As shown in FIG. 17, the inner platen 334 has a cavity 337 on an inner side 338 thereof configured to receive a generally heart shaped bag/receptacle (not shown). Also, the outer platen 336 is provided with a planar surface on an inner side 339 thereof. These platens 334 and 336 can be easily interchanged with the platens 134 and 136.

From the foregoing description it will be apparent that the platen, holder and latch assembly 16 (18) or 116 provides a number of advantages, some of which have been described above and others of which are inherent in the invention. More specifically, the holder 118 and slide in platens 134, 136 or 334, 336 permit easy replacement or interchange of platens. Moreover, the pressure applying members 200 allow the pressure on the platens 134, 136 or 334, 336 to be adjusted as desired.

Also, the latch mechanism 32 or 220 of the present invention has a number of advantages, some of which have been described above and others of which are inherent in the invention. Specifically, by having a toggle locking action in the latch mechanism 32 or 220, a simple and effective means is provided for clamping the inner platen 24 or 134 to the outer platen 26 or 136 with a bag/receptacle 20 or 160 therebetween.

Also, if any vibrations are incurred in the operation of the centrifuge device, the centrifugal force on the handle 60 or linkages 222, 224 and on the inner platen 24 or 134 is such as to urge the pins 66 or first links 222 toward a latched position to maintain the platens 24, 26 or 134, 136 latched together. Furthermore, when it is desired to open or close the platen assembly, this can be simply and easily accomplished by merely moving the handle 60 or linking pivot connections 231 upwardly or downwardly as described above so that the plastic bag/receptacle 20 (22) or 160 can be easily inserted or removed from the assembly 16 (18) or 116.

It will be apparent from the foregoing description that obvious modifications and variations can be made to the assembly 16 or 116 of the present invention without departing from the teachings of the invention and accordingly the scope of the invention is only to be limited as necessitated by the accompanying claims.

We claim:

1. In a centrifuge of the type wherein a receptacle is received and held between first and second platens which are held in generally upright respective inner and outer parallel planes spaced radially outwardly from a vertical axis of rotation of the device with the first platen being situated in the inner plane and the second platen being fixed in the outer plane, the improvement comprising a platen holder and latch assembly including a holder having a fixed outer wall and a movable inner wall pivotally mounted to the bottom of said fixed outer wall, a first platen positioned in said holder against said inner wall and movable therewith, a second platen positioned within said holder against said outer wall, said platens being removable, replaceable platens which are slidably insertable into said holder from the top thereof, and a latch mechanism associated with said inner and outer walls of said holder and having means providing a toggle locking between said inner and outer walls.

2. The assembly according to claim 1 wherein one of said platens is made of an elastomeric material and one of said platens is made out of metal.

3. The assembly according to claim 2 wherein said first platen is made of metal and said second platen is made of an elastomeric material.

4. The assembly according to claim 3 wherein said second platen is made of polypropylene.

5. The assembly according to claim 1 wherein said outer wall has a concave formation facing into said holder and said second platen has a mating convex configuration on an outer side thereof.

6. The assembly according to claim 1 wherein one of said platens has a cavity in the inner side thereof for receiving a receptacle, said cavity having a configuration particularly adapted for receiving a receptacle having a similar configuration.

7. The assembly according to claim 6 wherein the other of said platens has a planar surface on the inner side thereof such that the receptacle is received in said cavity on one side and against said planar surface on the other side.

8. The assembly according to claim 1 wherein each of said platens has a top edge and a lip formation extending from said top edge for engaging an upper edge of one of said walls of said holder when said platens are inserted in said holder.

9. The assembly according to claim 1 wherein one of said platens has slots in the inner side thereof and the other of said platens has pins extending from the inner side thereof for being received in said slots for properly aligning and locating said platens relative to each other within said holder.

10. The assembly according to claim 1 including means associated with said inner wall for applying pressure against said first platen to urge said first platen against said second platen with a receptacle disposed therebetween so as to clamp said platens together when said walls are latched together.

11. The assembly according to claim 10 wherein said pressure applying means comprise at least four pressure members on said inner wall facing inwardly into said holder toward said outer wall.

12. The assembly according to claim 11 wherein said pressure members are positioned at four respective pressure points which form a rectangular configuration.

13. The assembly according to claim 10 wherein said inner wall has a plurality of bores therethrough and wherein said pressure applying means include plug members each having a stem portion received in respective bores, each plug member having a cavity therein which opens onto the bottom of said stem portion and which faces inwardly of said holder toward said outer wall, resilient means received in said cavity and a cap member over said resilient means and protruding from said inner side of said inner wall, said cap member being adapted to engage and resiliently bear against said first platen.

14. The assembly according to claim 13 wherein each cavity is generally cylindrical with a pin fixed therein and wherein each said resilient means comprises a plurality of non-planar, dish shaped washers which are made of a spring metal and which are received on said pin with said associated cap member being received over the free end of said pin and against said washers.

15. In a centrifuge of the type wherein a receptacle is received and held between first and second platens which are held in generally upright respective inner and outer parallel planes spaced radially outwardly from a vertical axis of rotation of the device with the first platen being situated in the inner plane and the second platen being fixed in the outer plane, the improvement comprising a platen holder and latch assembly including a holder having a fixed outer wall and a movable inner wall pivotally mounted to the bottom of said fixed outer wall, a first platen positioned in said holder against said inner wall and movable therewith, a second platen positioned within said holder against said outer wall, said latch mechanism including first and second linkages, each linkage being pivotally connected on one side thereof to a side flange extending from said outer wall and on the other side to a side edge of said inner wall.

16. The assembly according to claim 15 wherein a horizontally extending shaft is rotatably journalled to said inner wall at the top thereof with one end of each of said linkages being mounted to one end of said shaft.

17. The assembly according to claim 15 wherein each of said linkages includes a first link and a second link, each of which is pivotally connected at one end thereof to the other link, the other end of each said link being pivotally connected to said flange of said outer side wall or said side edge of said inner wall.

18. The assembly according to claim 17 wherein each said first link is shorter than said link and has a first end pivotally connected to a first end of said second link and a second end pivotally connected to a side edge of said inner wall and said second link has a second end thereof pivotally connected to a side flange of said outer wall.

19. The assembly according to claim 17 wherein said first link in each linkage is shorter than said second link in each linkage and wherein two respective linking pivot connections between said first and second links in each of said linkages are generally coaxial and wherein said pivot connections of said links and said links of said linkage are constructed, arranged and designed so that said linking pivot connection can move between a first, holder open position where the axis extending through and between said linking pivot connections extends generally parallel to and between said inner and outer walls, upwardly and arcuately in such a way as to cause said inner wall to move outwardly toward said outer wall, downwardly and arcuately such that said second link moves through an arc of approximately 180° about said linking pivot connection to a second, holder closed position where said platens are pressed together with a receptacle therebetween and in such a way that said inner wall is moved to a furthest closed position between said walls and then slightly away from said outer wall to said holder closed position to provide a toggle locking action and in such a way that said inner wall is moved slightly toward and then away from said outer wall as said linking pivot connections are rotated upwardly to unlatch said inner and outer walls.

* * * * *